US006635166B2

(12) United States Patent
Saji et al.

(10) Patent No.: US 6,635,166 B2
(45) Date of Patent: Oct. 21, 2003

(54) COMPOSITE PLATING METHOD

(75) Inventors: Tetsuo Saji, Tokyo (JP); Kumar Nabeen Shrestha, Tokyo (JP)

(73) Assignee: Japan Science and Technology Corporation, Saitami (JP)

( * ) Notice: Subject to any disclaimer, the term of this patent is extended or adjusted under 35 U.S.C. 154(b) by 0 days.

(21) Appl. No.: 09/959,722

(22) PCT Filed: Mar. 6, 2001

(86) PCT No.: PCT/JP01/01723

§ 371 (c)(1),
(2), (4) Date: Dec. 4, 2001

(87) PCT Pub. No.: WO01/66831

PCT Pub. Date: Sep. 13, 2001

(65) Prior Publication Data

US 2002/0157957 A1 Oct. 31, 2002

(30) Foreign Application Priority Data

Mar. 6, 2000 (JP) ..... 2000-061264

(51) Int. Cl.[7] ..... C25D 15/00

(52) U.S. Cl. ..... 205/109; 205/110; 205/280; 205/308; 205/267; 205/290; 205/296; 205/279; 205/297

(58) Field of Search ..... 205/109, 110, 205/238, 261, 280, 308, 267, 290, 296, 279, 297; 148/426, 432, 441, 423, 427, 430, 433, 434, 435

(56) References Cited

U.S. PATENT DOCUMENTS 4,036,711 A * 7/1977 Kardos et al. ..... 205/296
6,077,815 A * 6/2000 Grunthaler et al. ..... 508/108

FOREIGN PATENT DOCUMENTS

JP 2-305997 12/1990

* cited by examiner

*Primary Examiner*—Roy King
*Assistant Examiner*—Wesley A. Nicolas
(74) *Attorney, Agent, or Firm*—Wenderoth, Lind & Ponack, LLP

(57) ABSTRACT

Inorganic or organic fine particles which are insoluble to water are added to a metal plating bath, by dispersing the fine particles in a watery medium by the help of an azo-surfactant having an aromatic azo compound residue. Electrolysis is then carried out. According to the present invention, the content of the fine particles present in a composite plating film composed of the fine particles and a metal can be increased.

4 Claims, 6 Drawing Sheets

COMPOSITE PLATING METHOD

TECHNICAL FIELD

The preset invention relates to a composite plating method of forming a composite film composed of fine particles and metal. More specifically, the present invention relates to a new method of forming a composite plating film in which the content of the fine particles can be controlled.

BACKGROUND ART

A composite plating method is conventionally known as a plating method in which fine particles of alumina, silicon carbide or the like are dispersed in a metal plating bath so that the fine particles are present in the eutectoid state in the plating metal.

The main effects achieved by a composite plating film obtained by such a method include (1) improvement of wear resistance, (2) improvement of lubricity, (3) improvement of corrosion resistance, (4) change in surface appearance, (5) improvement of mechanical properties of the plating, and the like. In order to achieve such effects in actual applications, it to desirable that the content of the fine particles in the metal is raised as high as possible.

In the conventional composite plating method as described above, a surfactant is added in order to disperse the fine particles or change the surface potential and then the mixture is stirred to effect electroplating. However, addition of a surfactant has only a limited effect of enhancing the content of the fine particles in the plating metal, although such addition of a surfactant can increase the content of the fine particles to some extent. It is assumed that the effect by a surfactant is limited because the surfactant remains as it is on the fine particles which have been deposited by plating in the adsorbed state and prevents other fine particles from being deposited.

Accordingly, such a problem associated with addition of a surfactant i.e., the difficulty of enhancing the content of the fine particles to a significantly high level which exceeds a certain content value has remained unsolved in the conventional technique.

DISCLOSURE OF INVENTION

An object of the present invention is to solve the aforementioned problems and provide a method of forming a composite plating film in which the content of fine particles can be increased. Specifically, the present invention provides a composite plating method, characterized in that it comprises the steps of: adding inorganic or organic fine particles which are insoluble to water, to a metal plating bath, by dispersing the fine particles in a watery medium by the help or an azo-surfactant having an aromatic azo compound residue; and effecting electrolysis, thereby forming a composite plating metal film composed of the fine particles and a metal.

Further, the present invention provides a composite plating metal film formed by the aforementioned method.

BEST MODE FOR CARRYING OUT THE INVENTION

Figure 1:
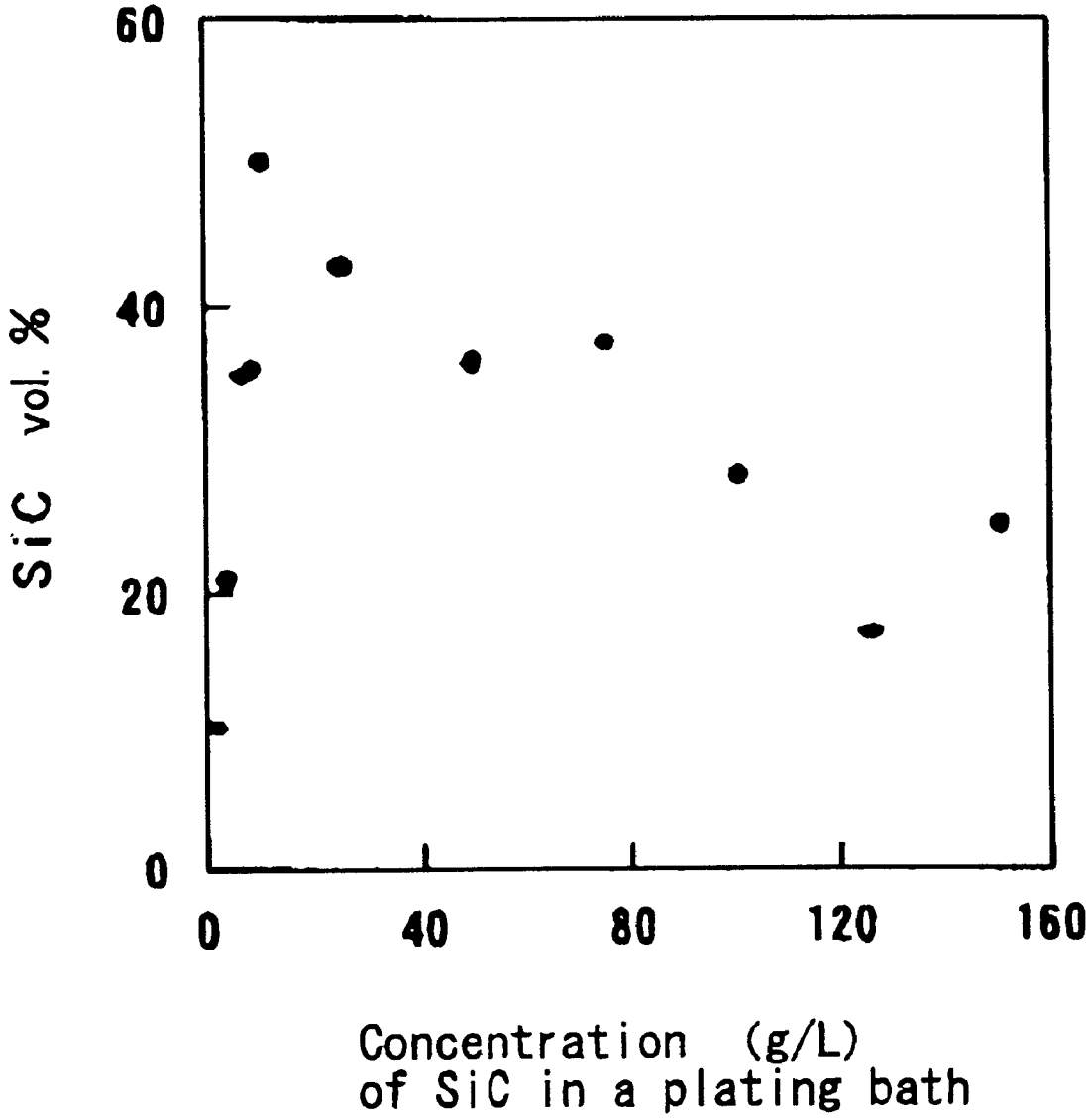
FIG. 1 is a graph which illustrates the relationship between the amount of SiC added in a plating bath and the amount of deposited SiC.

An embodiment of the present invention, which has characteristics as described above, will be described hereinafter.

First of all, the object of the present invention is to enhance the content of inorganic or organic water-insoluble fine particles in a metal plating film to a significantly high level which exceeds the conventional limit. This object is to be easily solved by: adding an azobenzene-modified surfactant whose activity as a surfactant is lost by reduction, together with fine particles, to a metal plating bath; reducing the surfactant simultaneous with the reduction of the metal ion, so that the surfactant is detached from the fine particle surface; and allowing the fine particles to be deposited on the surface of a base plate, with the metal, in an eutectoid state.

The azobenzene-modified surfactant is characterized in that the surfactant includes an aromatic azo compound residue. It is preferable that the azobenzene-modified surfactant includes the aromatic azo-compound residue at a hydrophobic portion thereof.

Regarding the structure of the surfactant, any type of a surfactant selected from the group consisting of a non-ionic surfactant, a cationic surfactant, an anionic surfactant and an amphoteric surfactant can be used. Examples of the aromatic azo compound residue which can be employed in the present invention include an azo group having a benzene ring, an azo group having a substituted benzene ring, and an azo ring having a naphthalene ring.

As the azobenzene-modified surfactant, two or more types thereof may be used together in an appropriately combined manner.

The fine particles used in the present invention described above may be selected from any types of fine particles which are generally employed for the conventional composite plating. Examples of the fine particles which can be used in the present invention include $Al_2O_3$, $Cr_2O_3$, $Fe_2O_3$, $TiO_2$, $ZrO_2$, $ThO_2$, $SiO_2$, $CeO_2$, $BeO_2$, MgO, CdO, diamond, SiC, TiC, WC, VC, ZrC, TaC, $Cr_3C_2$, $B_4C$, BN, $ZrB_2$, TiN, $Si_3N_4$, $WSi_2$, MoS, $WS_2$, $CaF_2$, $BaSO_4$, $SrSO_4$, ZnS, CdS, $TiH_2$, NbC, $Cr_3B_2$, $UO_2$, graphite fluoride, graphite, glass, kaolin, corundum and a colorant, etc. Specific examples of the colorant include: an oil soluble dye such as C.I. Solvent Yellow 2, C.I. Solvent Red 3 raised in pages 839–878 of "Senryo Binran" issued by Maruzen on Jul. 20, 1970; an organic pigment such as C.I. Pigment Blue 15 raised in pages 987–1109 of "Senryo Binran" and "Color Chemical Dictionary" issued by C. M. C on Mar. 28, 1988; a hydrophobic compound selected from the group consisting of the colorants for electronics, the colorants for recording, the colorants for environmental chromism, the colorants for photography, and the colorants for energy raised in 542–591 of "Color Chemical Dictionary". Further, the fine particles may be made of a water insoluble polymer. Examples of such a polymer include PTFE, polystyrene, polypropylene, polycarbonate, polyamide, polyacrylonitril, polypyrrole, polyaniline, acetyl cellulose, polyvinyl acetate, polyvinyl butyral, and a copolymer (a polymer formed by methyl methacrylate and methacrylic acid). Either a single type of the aforementioned particles or two or more types thereof in combination may be used as the fine particles of the present invention.

The present invention will be described more specifically hereinafter. The electrolytic plating bath which can be used in the method of the present invention may be an electrolytic plating bath which is generally used in the conventional metal plating. Examples of the electrolytic plating bath include electrolytic plating baths of nickel, copper, zinc, tin, lead, chromium, gold, silver and alloy thereof.

The temperature during the composite plating process is generally set within a range of the room temperature to 60° C. but may be higher than 60° C. The pH of the electrolytic plating bath is preferably no higher than 3.

The content of the fine particles present in the composite plating film can be adjusted by changing the concentration of the surfactant and the amount of the fine particles to be added.

A case in which a Watts bath is used as the plating liquid will be described in detail with illustration. The composition of the Watts bath may include, for example, 300 g/L of $NiSO_4.H_2O$, 60 g/L of $NiCl_2.H_2O$, 40 g/L or $H_3BO_4$ and 5 g/L of $NaH_2PO_4$. Silicon carbide (SiC) is evenly dispersed in the Watt bath by ultrasonic processing using an azo-surfactant. A nickel plate as the counter electrode and a base plate having area of 3.0 $cm^2$ as the anode are provided in the plating liquid, and a constant-current electrolysis in carried out for 30 minutes with stirring, to effect composite plating.

As the azo-surfactant, AZTAB represented by the following structural formula

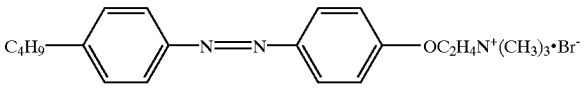

or AZTAB2 represented by the following structural formula

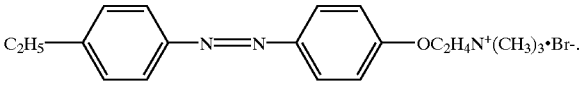

may be used.

FIG. 1 shows the relationship between the amount of added SiC and the deposit layer of SiC at the electrodeposit layer, in a case in which the amount of added AZTAB is 1 g/L, the current density is 10 $A/dm^2$, the electrolysis time is 30 minutes and the temperature of the bath is 50° C. From FIG. 1, it is understood that the amount of SiC in the eutectoid state is largest (50.4 vol. %) when the concentration of SiC in the plating bath is 10 g/L.

Figure 2:
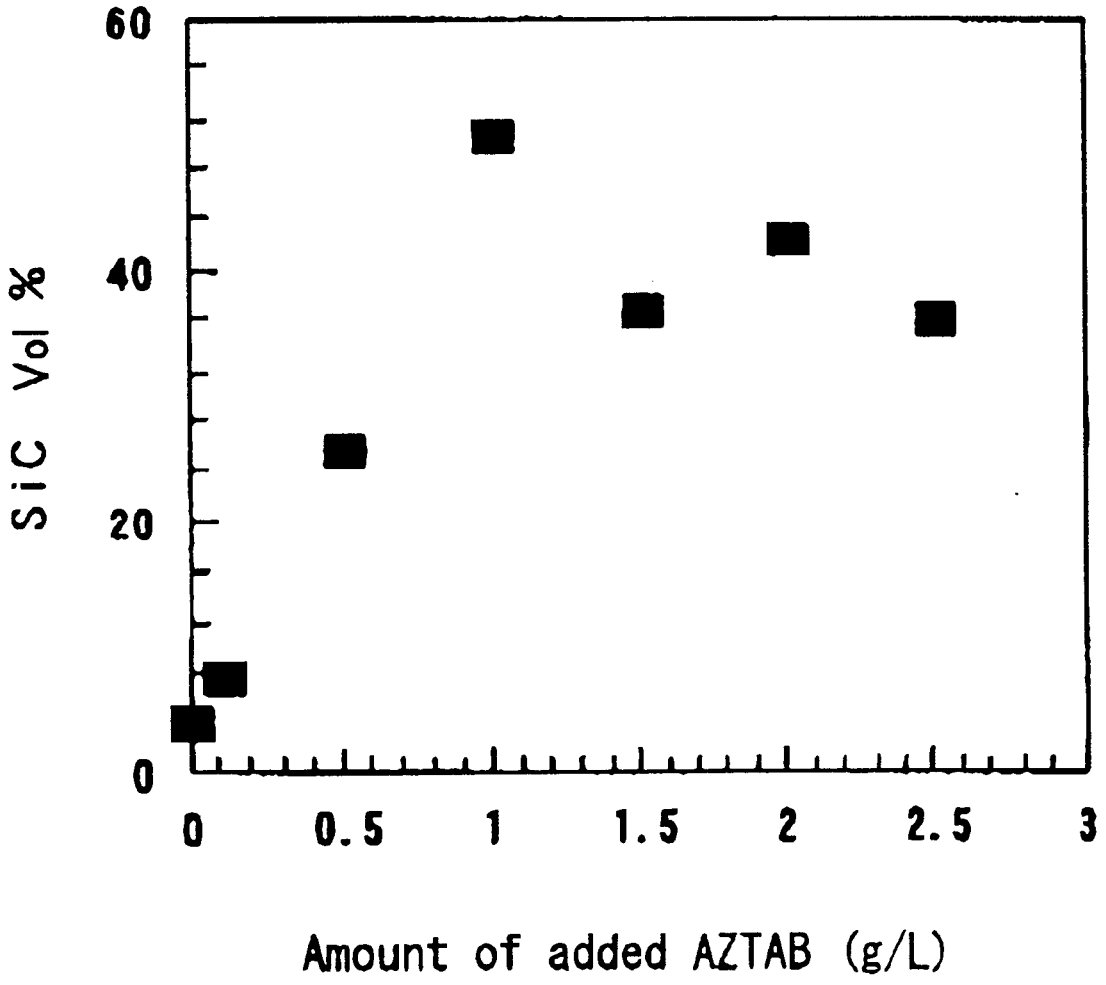
FIG. 2 is a graph which illustrates the relationship between the amount of AZTAB added in a plating bath and the amount of deposited SiC.

FIG. 2 shows the relationship between the amount of the aromatic azo-modified surfactant (AZTAB) which has been added and the deposit layer of SiC at the electrodeposit layer, in a case in which the amount of added SiC is 10 g/L, the current density is 10 $A/dm^2$, the electrolysis time is 30 minutes and the temperature of the plating bath is 50° C. From FIG. 2, it is understood that the limit of the content of SiC in the eutectoid state is 50.4 vol. %.

Figure 3:
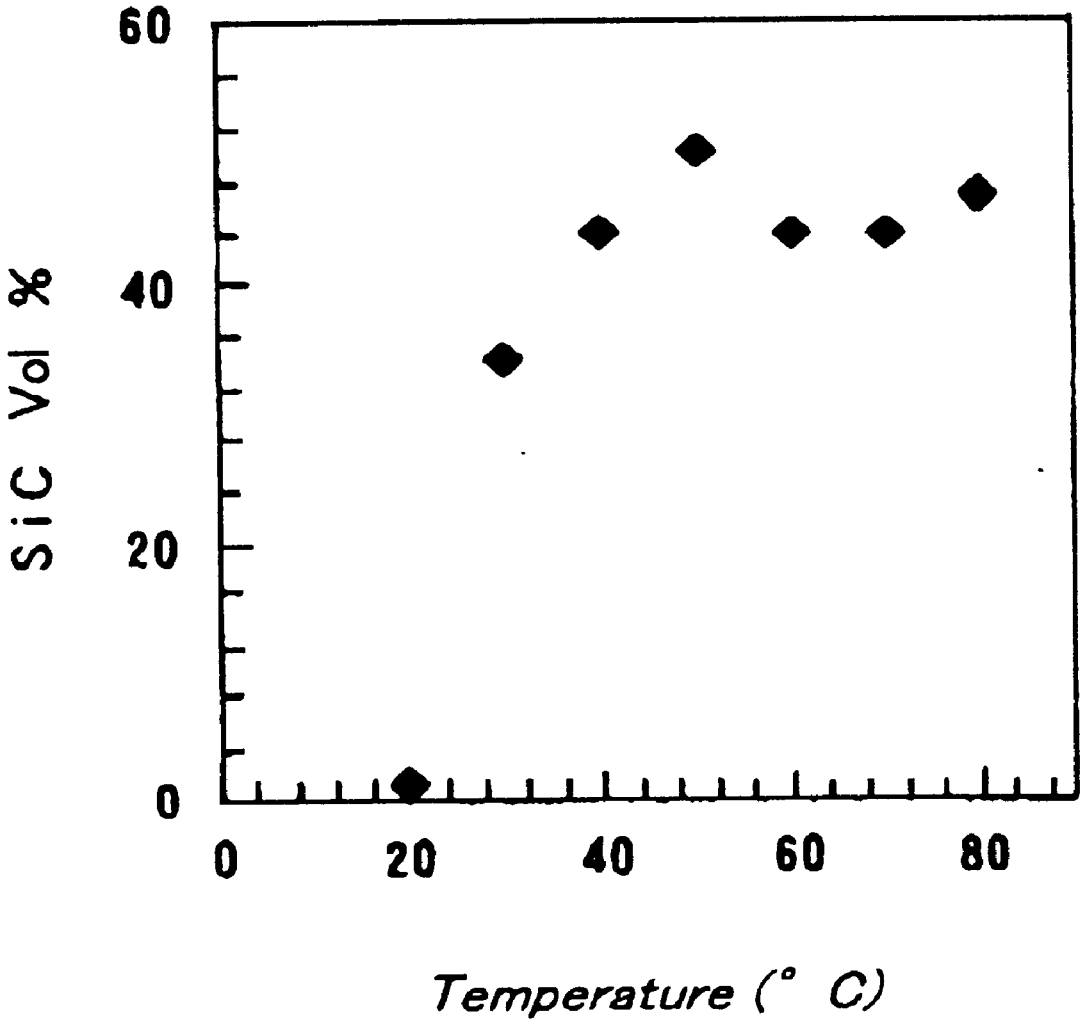
FIG. 3 is a graph which illustrates the relationship between the temperature of a plating bath and the amount of deposited SiC.

FIG. 3 shows the relationship between the temperature of the plating bath and the deposit layer of SiC at the electrodeposit layer, in a case in which the amount of added SiC is 10 g/L, the amount of added AZTAB is 1 g/L, the current density is 10 $A/dm^2$, the electrolysis time is 30 minutes. From FIG. 3, it is understood that the content of deposited SiC (vol. %) substantially reaches a plateau in a temperature range of 40° C. or higher.

Figure 4:
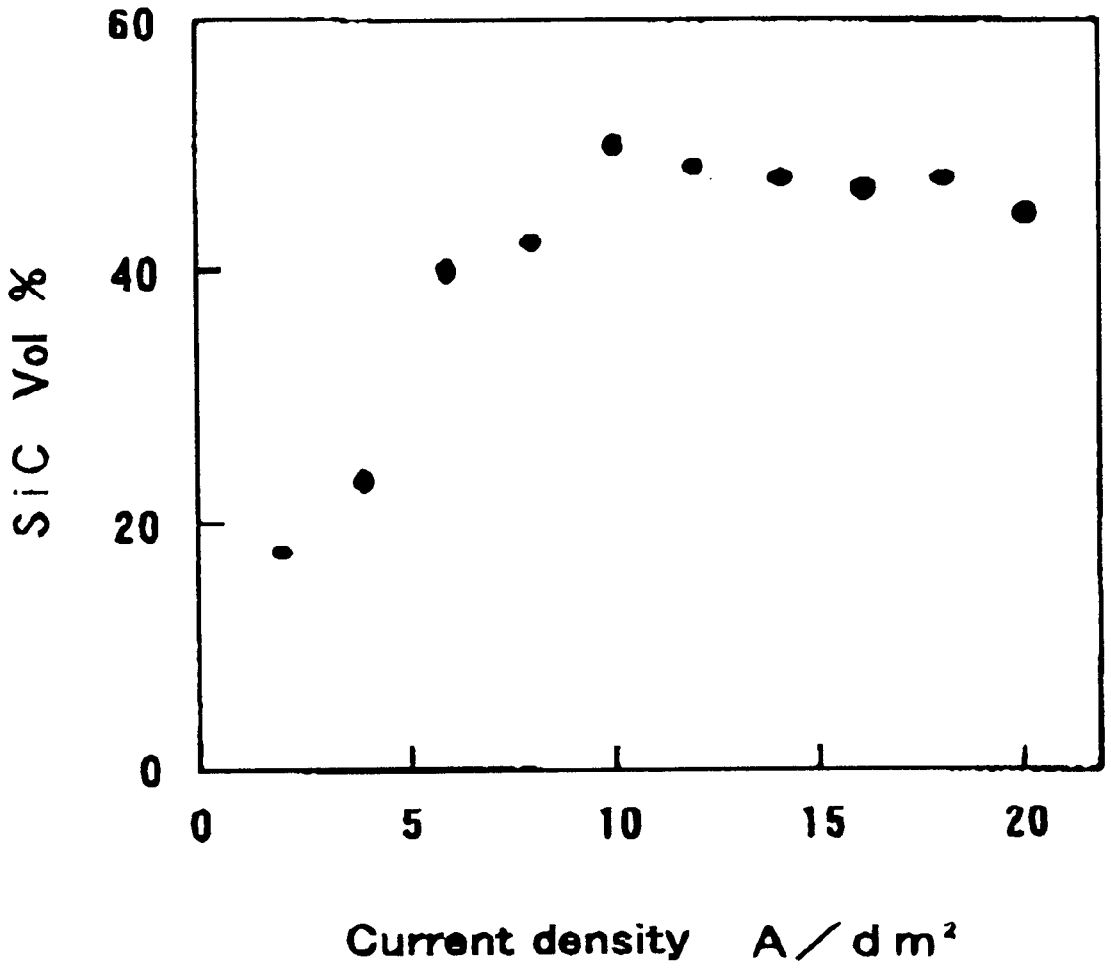
FIG. 4 is a graph which illustrates the relationship between the current density and the amount of deposited SiC.

FIG. 4 shows the relationship between the current density and the deposit layer of SiC at the electrodeposit layer, in a case in which the amount of added SiC is 10 g/L, the amount of added AZTAB is 1 g/L, the electrolysis time is 30 minutes and the temperature of the bath is 50° C. From FIG. 4, it is understood that the content of deposited SiC (vol. %) substantially reaches a plateau in a current-density range of 10 $A/dm^2$ or higher.

From the results of the aforementioned tests, it is understood that a composite film having a relatively large content of deposited SiC in spite of a relatively small amount (10 g/L) of SiC addition can be produced by employing an aromatic azo-modified surfactant. When a surfactant which is not modified with an aromatic azo group is used, a plating bath having an extremely large SiC content must be used, in general, in order to form a composite film which has such a large content of deposited SiC as that of the present invention. For example, in order to produce a composite film whose deposited SiC content is 48.12 vol. % by using a surfactant which is not modified with an aromatic azo group, a plating bath containing 600 g/L of SiC is required (R. F. Ehrsam, U.S. Pat. No. 4,043,878, 1977).

The present invention will be further described by the examples hereinafter. It should be noted that the present invention is not restricted, in any manner, by the following examples.

EXAMPLES

Example 1

0.4 g of SiC and 20 mg of the aforementioned AZTAB were added to 50 ml of an aqueous solution of pH 1 (the pH had been adjusted to be pH 1 by HCl) containing 15 g of $NiSO_4.H_2O$, 3 g of $NiCl_2.H_2O$, 2 g of $H_3BO_4$ and 0.25 g of $NaH_2PO_4$. The mixture was subjected to the ultrasonic processing, whereby a plating liquid was prepared. A nickel plate as the counter electrode and a copper plate having area of 3.0 $cm^2$ as the anode were each provided in the plating liquid, and a constant-current electrolysis was carried out for 30 minutes at 50° C., with the current density of 10 $Adm^{-2}$, to effect composite plating.

Figure 5:
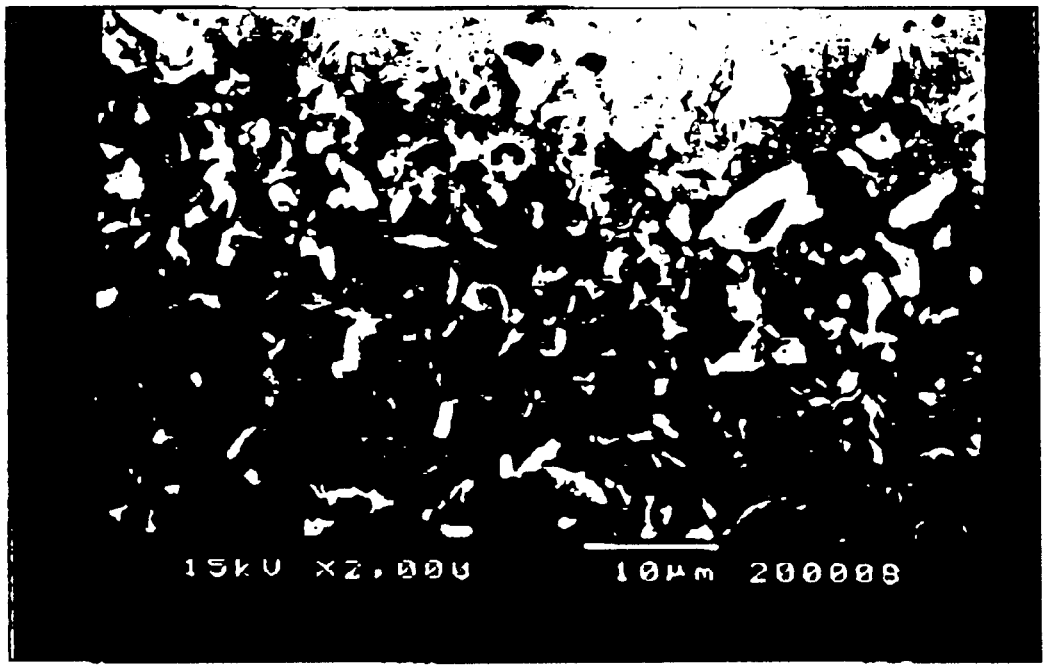
FIG. 5 is an electron microscope photograph of a composite film of example 1.

The content of SiC in the composite plating film measured by the EDX measurement was 35.50 vol. %. FIG. 5 is an electron microscope photograph (magnification×2000 times) which shows the composite thin film obtained in the present example.

Example 2

0.5 g of SiC and 20 mg of the aforementioned AZTAB were added to 50 ml of an aqueous solution of pH 1 (the pH had been adjusted to be pH 1 by HCl) containing 15 g of $NiSO_4.H_2O$, 3 g of $NiCl_2.H_2O$, 2 g of $H_3BO_4$ and 0.25 g of $NaH_2PO_4$. The mixture was subjected to the ultrasonic processing, whereby a plating liquid was prepared. A nickel plate as the counter electrode and a copper plate having area of 3.0 $cm^2$ as the anode were each provided in the plating liquid, and a constant-current electrolysis was carried out for 30 minutes at 50° C., with the current density of 10 $Adm,^{-2}$, to effect composite plating.

Figure 6:
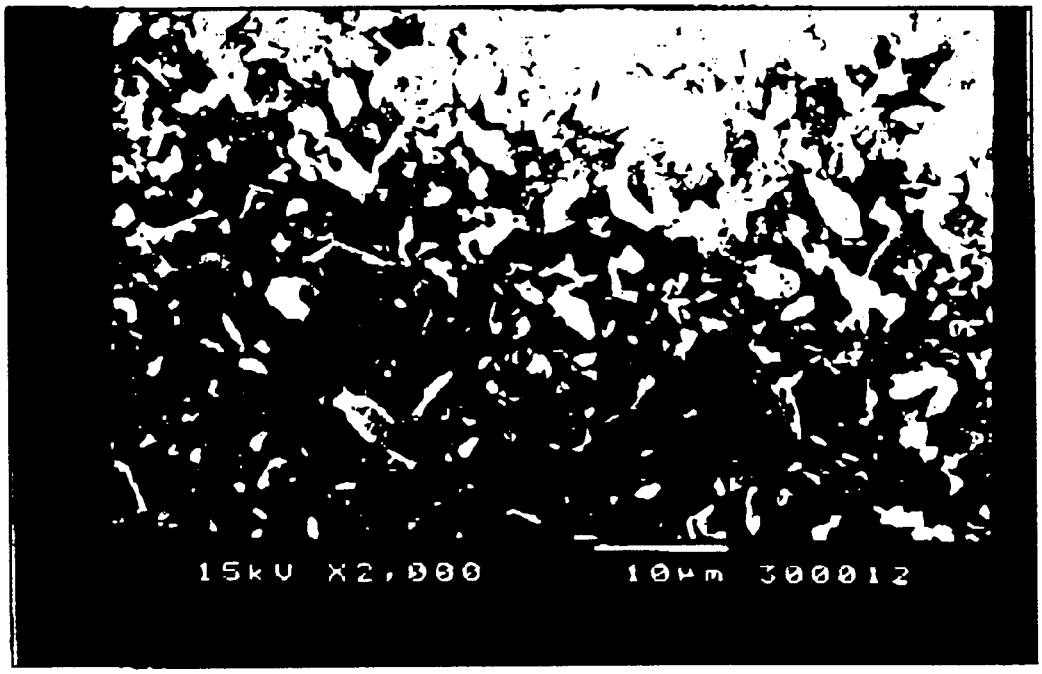
FIG. 6 is an electron microscope photograph of a composite film of example 2.

The content of SiC in the composite plating film measured by the EDX measurement was 50.37 vol. %. FIG. 6 is an electron microscope photograph (magnification×2000 times) which shows the composite thin film obtained in the present example Example 3

0.75 g of SiC and 175 mg of the aforementioned AZTAB2 were added to 50 ml of an aqueous solution of pH 1 (the pH had been adjusted to be pH 1 by HCl) containing 15 g of $NiSO_4.H_2O$, 3 g of $NiCl_2.H_2O$, 2 g of $H_3BO_4$ and 0.25 g of $NaH_2PO_4$. The mixture was subjected to the ultrasonic processing, whereby a plating liquid was prepared. A nickel plate as the counter electrode and a copper plate having area of 3.0 $cm^2$ as the anode were each provided in the plating liquid, and a constant-current electrolysis was carried out for 30 minutes at 50° C., with the current density of 10 $Adm^{-2}$, to effect composite plating.

The content of SiC in the composite plating film measured by the EDX measurement was 62.4 vol. %.

Industrial Applicability

As described above in detail, the present invention enables increasing the content of fine particles present in a metal plating film to a significantly high level which far exceeds the conventional limit thereof. Accordingly, a composite plating metal film which exhibits excellent properties in actual application is provided.

What is claimed is:

1. A composite plating method, which comprises the steps of: adding inorganic or organic fine particles which are insoluble in water, to a metal plating bath, by dispersing the fine particles in an aqueous medium containing an ionic azo-surfactant having an aromatic azo compound residue; and effecting electrolysis, thereby forming a composite plating metal film composed of the fine particles and a metal.

2. The method of claim 1 wherein the ionic azo-surfactant is selected from the following formula (I) or (II):

(I)

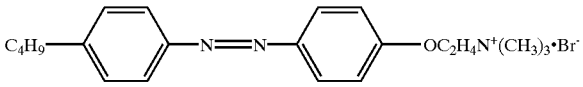

(II)

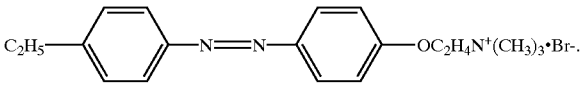

3. The method according to claim 2 wherein the fine particles are SiC.

4. The method according to claim 3 wherein the amount of SiC in the plating film is 35.5 to 62.4 vol %.

* * * * *

UNITED STATES PATENT AND TRADEMARK OFFICE

CERTIFICATE OF CORRECTION

PATENT NO. : 6,635,166 B2
DATED : October 21, 2003
INVENTOR(S) : Tetsuo Saji et al.

It is certified that error appears in the above-identified patent and that said Letters Patent is hereby corrected as shown below:

Title page,
Item [86], PCT No.: replace "PCT/JP01/01723" with -- PCT/JP01/01732 --.

Signed and Sealed this

Twenty-fifth Day of May, 2004

JON W. DUDAS
*Acting Director of the United States Patent and Trademark Office*